US009042746B2

(12) United States Patent
Elliott et al.

(10) Patent No.: US 9,042,746 B2
(45) Date of Patent: May 26, 2015

(54) METHODS FOR PROVIDING A PAGE COUNTDOWN FOR A REPLACEABLE UNIT OF AN IMAGE FORMING DEVICE

(71) Applicant: Lexmark International, Inc., Lexington, KY (US)

(72) Inventors: Delbert Lester Elliott, Georgetown, KY (US); Steven Wayne Parish, Lexington, KY (US); Kevin Dean Schoedinger, Lexington, KY (US); Jason Carl True, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 152 days.

(21) Appl. No.: 13/711,924

(22) Filed: Dec. 12, 2012

(65) Prior Publication Data

US 2014/0105619 A1 Apr. 17, 2014

Related U.S. Application Data

(60) Provisional application No. 61/715,081, filed on Oct. 17, 2012.

(51) Int. Cl.
*G03G 15/08* (2006.01)
*G03G 15/00* (2006.01)

(52) U.S. Cl.
CPC ..... *G03G 15/5016* (2013.01); *G03G 15/553* (2013.01); *G03G 15/086* (2013.01); *G03G 15/556* (2013.01)

(58) Field of Classification Search
USPC ..... 399/24, 25, 27
See application file for complete search history.

(56) References Cited

U.S. PATENT DOCUMENTS 5,634,169 A 5/1997 Barry et al.
5,729,351 A 3/1998 Oh
6,456,802 B1 9/2002 Phillips (Continued)

FOREIGN PATENT DOCUMENTS

JP 04098265 A 3/1992
JP 06-142035 A2 5/1994

OTHER PUBLICATIONS

U.S. Appl. No. 13/711,955, filed Dec. 12, 2012.

(Continued)

*Primary Examiner* — David Bolduc
*Assistant Examiner* — Barnabas Fekete
(74) *Attorney, Agent, or Firm* — Justin M Tromp

(57) ABSTRACT

A method for providing a page countdown for a replaceable unit of an image forming device according to one embodiment includes calculating a number of pages remaining until the replaceable unit will reach the end of its life. The calculated number of pages remaining until the replaceable unit will reach the end of life is displayed on a display screen. After the calculated number of pages remaining is displayed, the displayed number of pages remaining is decreased by one for each page printed, the number of pages remaining is recalculated and a discrepancy between the displayed number of pages remaining and the recalculated number of pages remaining is tracked. If the discrepancy exceeds a predetermined error threshold, the recalculated number of pages remaining is displayed and the displayed number of pages remaining continues to be decreased by one for each page printed from the displayed recalculated number of pages remaining.

16 Claims, 7 Drawing Sheets

(56) References Cited

U.S. PATENT DOCUMENTS

| | | | | |
|---|---|---|---|---|
| 6,496,662 | B1 | 12/2002 | Buchanan et al. | |
| 6,546,212 | B1 | 4/2003 | Ogata et al. | |
| 6,600,882 | B1 | 7/2003 | Applegate et al. | |
| 6,819,884 | B1 | 11/2004 | Carter et al. | |
| 7,139,505 | B2 | 11/2006 | Askren et al. | |
| 7,218,871 | B2 | 5/2007 | Ogata | |
| 7,555,231 | B2 | 6/2009 | Etter et al. | |
| 2001/0001025 | A1* | 5/2001 | Nakajima | 399/120 |
| 2002/0141765 | A1* | 10/2002 | Phillips | 399/27 |
| 2004/0105689 | A1 | 6/2004 | Shimura et al. | |
| 2005/0265738 | A1 | 12/2005 | Ogata | |
| 2007/0286616 | A1 | 12/2007 | Kojima et al. | |
| 2008/0181625 | A1 | 7/2008 | Moodie et al. | |
| 2010/0303484 | A1 | 12/2010 | Hogan et al. | |
| 2012/0045224 | A1 | 2/2012 | Amann et al. | |

OTHER PUBLICATIONS

U.S. Appl. No. 13/711,985, filed Dec. 12, 2012.

Prosecution history of U.S. Appl. No. 13/711,955 including Non-Final Office Action dated Aug. 8, 2014.

Prosecution history of U.S. Appl. No. 13/711,985 including Notice of Allowance dated Jun. 11, 2014.

* cited by examiner

METHODS FOR PROVIDING A PAGE COUNTDOWN FOR A REPLACEABLE UNIT OF AN IMAGE FORMING DEVICE

CROSS REFERENCES TO RELATED APPLICATIONS

This application claims priority to U.S. Provisional Patent Application Ser. No. 61/715,081, filed Oct. 17, 2012, entitled "Methods for Providing a Countdown for a Replaceable Unit of an Image Forming Device," the content of which is hereby incorporated by reference in its entirety.

BACKGROUND

1. Field of the Disclosure

The present disclosure relates generally to image forming devices and more particularly to methods for providing a page countdown for a replaceable unit of an image forming device.

2. Description of the Related Art

Image forming devices such as printers and copiers generally utilize one or more units that must be replaced or refilled during the life of the device. For example, image forming devices often include one or more replaceable units that supply an image forming substance such as ink or toner to the device to be used by the device to form a printed image on a desired media. As these replaceable units run out of the image forming substance, the units must be replaced or refilled in order to continue printing. Users often face a dilemma of choosing the best time to replace these units. On one hand, if the user waits too long to replace the unit, print quality defects may occur from a lack of the image forming substance available in the device. On the other hand, if the user replaces the unit too soon, usable image forming substance remaining in the replaceable unit being removed may be wasted.

In order to help the user determine when to replace these units, some image forming devices display a notification or warning that the image forming substance is low. Other image forming devices display a notification that less than a fixed number of pages (e.g., "less than 500 pages") may be printed when the image forming substance gets low. In some instances, the number of pages displayed decreases in hundred page increments as additional image forming substance is used (e.g., "less than 500 pages," followed by "less than 400 pages," followed by "less than 300 pages," etc.). Other image forming devices display an estimate of the amount of image forming substance remaining in the form of a graphic that includes a filled area (representing a tank or a bottle having a fluid therein) that decreases as the image forming substance is consumed or a line that moves from a full mark toward an empty mark as the image forming substance is consumed. Another approach used by some image forming devices is to display an estimate of the image forming substance remaining in the form of a percentage, often in 10% increments. While these approaches provide the user with a general indication that the image forming substance is nearing an empty state, the user is still left to guess the best time to replace the unit to minimize the waste of usable image forming substance without risking print defects. Accordingly, an image forming device that provides a user with an indication of the remaining life of a replaceable unit with improved precision is desired.

SUMMARY

A method for providing a page countdown for a replaceable unit of an image forming device according to one example embodiment includes calculating a number of pages remaining until the replaceable unit will reach the end of its life. The calculated number of pages remaining until the replaceable unit will reach the end of its life is displayed on a display screen of at least one of the image forming device and a device in electronic communication with the image forming device. After the calculated number of pages remaining is displayed, the displayed number of pages remaining is decreased by one for each page printed by the image forming device, the number of pages remaining is recalculated and a discrepancy between the displayed number of pages remaining and the recalculated number of pages remaining is tracked. If the discrepancy exceeds a predetermined error threshold, the recalculated number of pages remaining is displayed and the displayed number of pages remaining continues to be decreased by one for each page printed from the displayed recalculated number of pages remaining.

A method for providing a page countdown for a toner cartridge removably installed in an image forming device according to one example embodiment includes determining whether a reservoir of the toner cartridge is out of usable toner. After determining that the reservoir is out of usable toner, an estimate of the number of pages remaining before a toner sump of an imaging unit will run out of usable toner is displayed on a display screen of at least one of the image forming device and a device in electronic communication with the image forming device. The displayed estimate of the number of pages remaining is decreased by one for each page printed by the image forming device using toner from the toner sump of the imaging unit. An error amount indicative of a discrepancy between the displayed estimate of the number of pages remaining and a number of pages remaining calculated based on the toner usage of the image forming device is tracked. If the tracked error amount satisfies a predetermined error threshold, the calculated number of pages remaining based on the toner usage of the image forming device is displayed and the displayed estimate of the number of pages remaining continues to be decreased by one for each page printed from the displayed calculated number of pages remaining.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
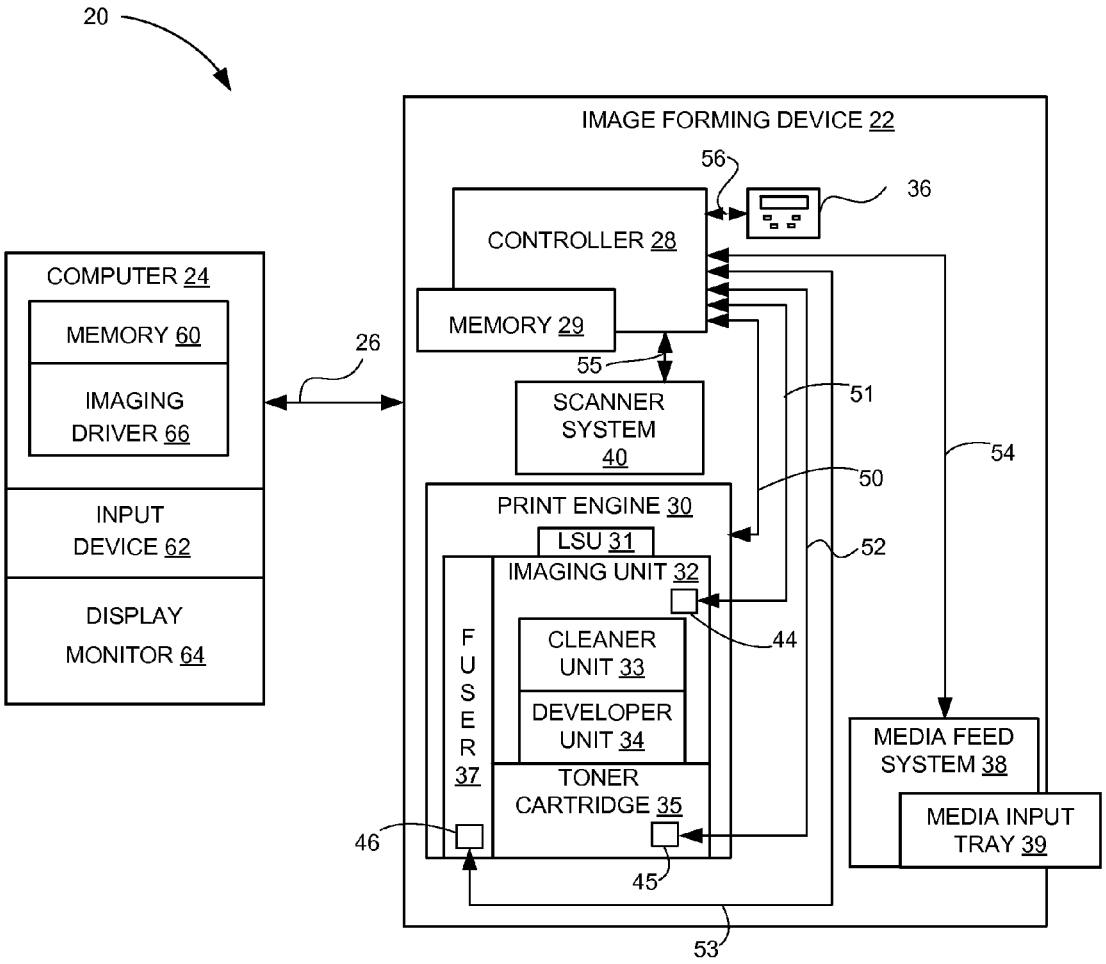
FIG. 1 is a block diagram of an imaging system according to one example embodiment.

Referring now to the drawings and more particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a fuser 37, a user interface 36, a media feed system 38 and media input tray 39 and a scanner system 40. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40, a standalone electrophotographic printer or a standalone scanner system.

Controller 28 includes a processor unit and associated memory 29 and may be formed as one or more Application Specific Integrated Circuits (ASICs). Memory 29 may be any volatile or non-volatile memory or combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 thereon via a communications link 52. Controller 28 communicates with fuser 37 and processing circuitry 46 thereon via a communications link 53. Controller 28 communicates with media feed system 38 via a communications link 54. Controller 28 communicates with scanner system 40 via a communications link 55. User interface 36 is communicatively coupled to controller 28 via a communications link 56. Processing circuitry 44, 45, 46 may include memory such as RAM, ROM, and/or NVRAM and may provide authentication functions, safety and operational interlocks, operating parameters and usage information related to imaging unit 32, toner cartridge 35 and fuser 37, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate the collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 35, imaging unit 32, and fuser 37, all mounted within image forming device 22. Imaging unit 32 is removably mounted in image forming device 22 and includes a developer unit 34 that houses a toner reservoir (or toner sump) and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system having storage for waste toner. Toner cartridge 35 is also removably mounted in image forming device 22 in a mating relationship with developer unit 34 of imaging unit 32. An exit port on toner cartridge 35 communicates with an entrance port on developer unit 34 allowing toner to be periodically transferred from a reservoir in toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred to a media sheet received by imaging unit 32 from media input tray 39 for printing. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
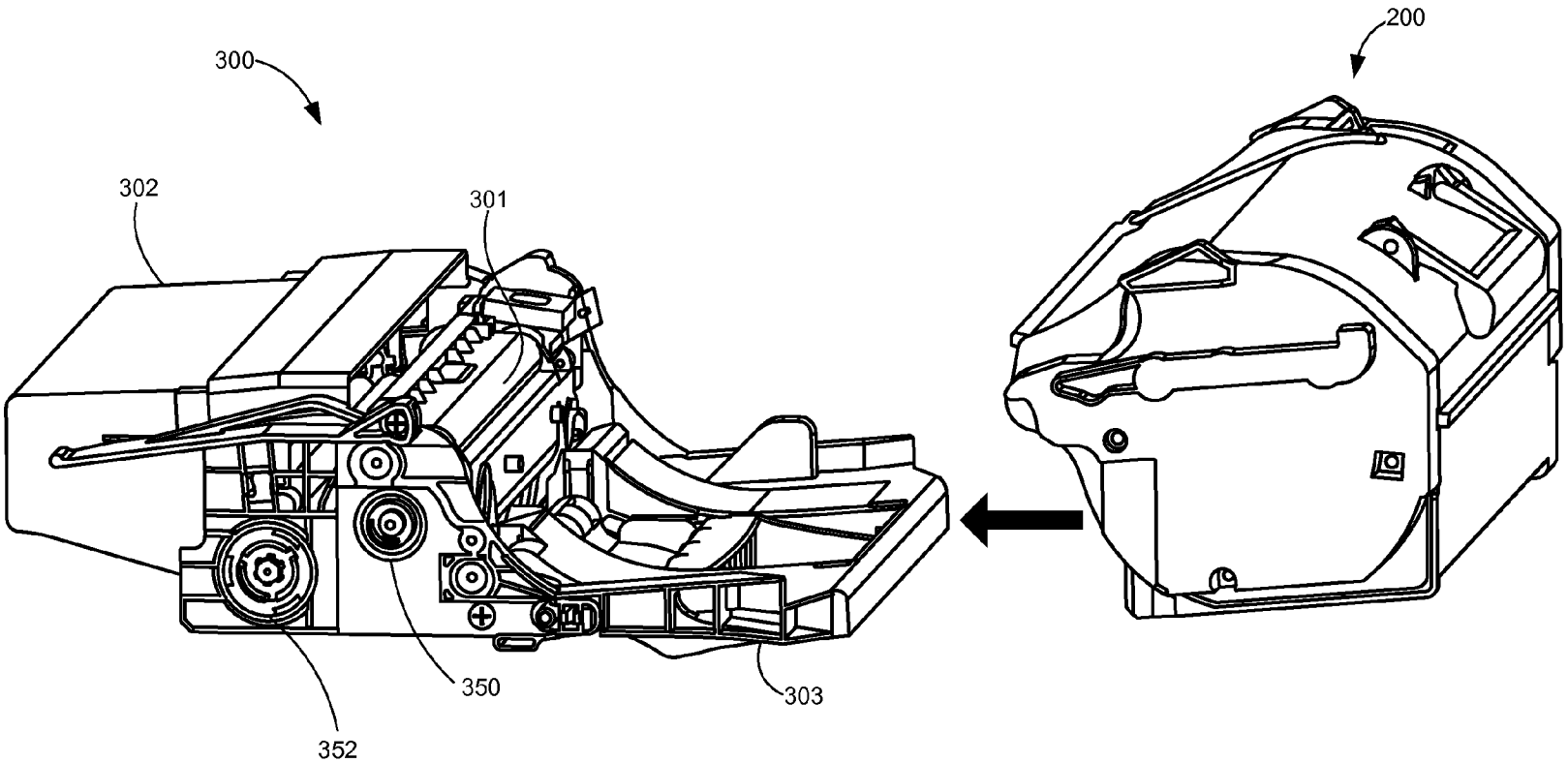
FIG. 2 is a perspective view of a toner cartridge and an imaging unit of FIG. 1 according to one example embodiment.

Referring now to FIG. 2, a toner cartridge 200 and an imaging unit 300 are shown according to one example embodiment. Imaging unit 300 includes a developer unit 301 and a cleaner unit 302 mounted on a common frame 303.

Imaging unit 300 also includes a pair of input couplers 350, 352 that receive torque at their axial ends from a drive system in image forming device 22 to drive various rotatable components in imaging unit 300. Specifically, input coupler 350 drives various rotatable components in developer unit 301 and input coupler 352 drives the photoconductive drum in cleaner unit 302. As discussed above, imaging unit 300 and toner cartridge 200 are each removably installed in image forming device 22. Imaging unit 300 is first slidably inserted into image forming device 22. Toner cartridge 200 is then inserted into image forming device 22 and onto frame 303 in a mating relationship with developer unit 301 of imaging unit 300 as indicated by the arrow shown in FIG. 2. This arrangement allows toner cartridge 200 to be removed and reinserted easily when replacing an empty toner cartridge without having to remove imaging unit 300. Imaging unit 300 may also be readily removed as desired in order to maintain, repair or replace the components associated with developer unit 301, cleaner unit 302 or frame 303 or to clear a media jam.

Figure 3:
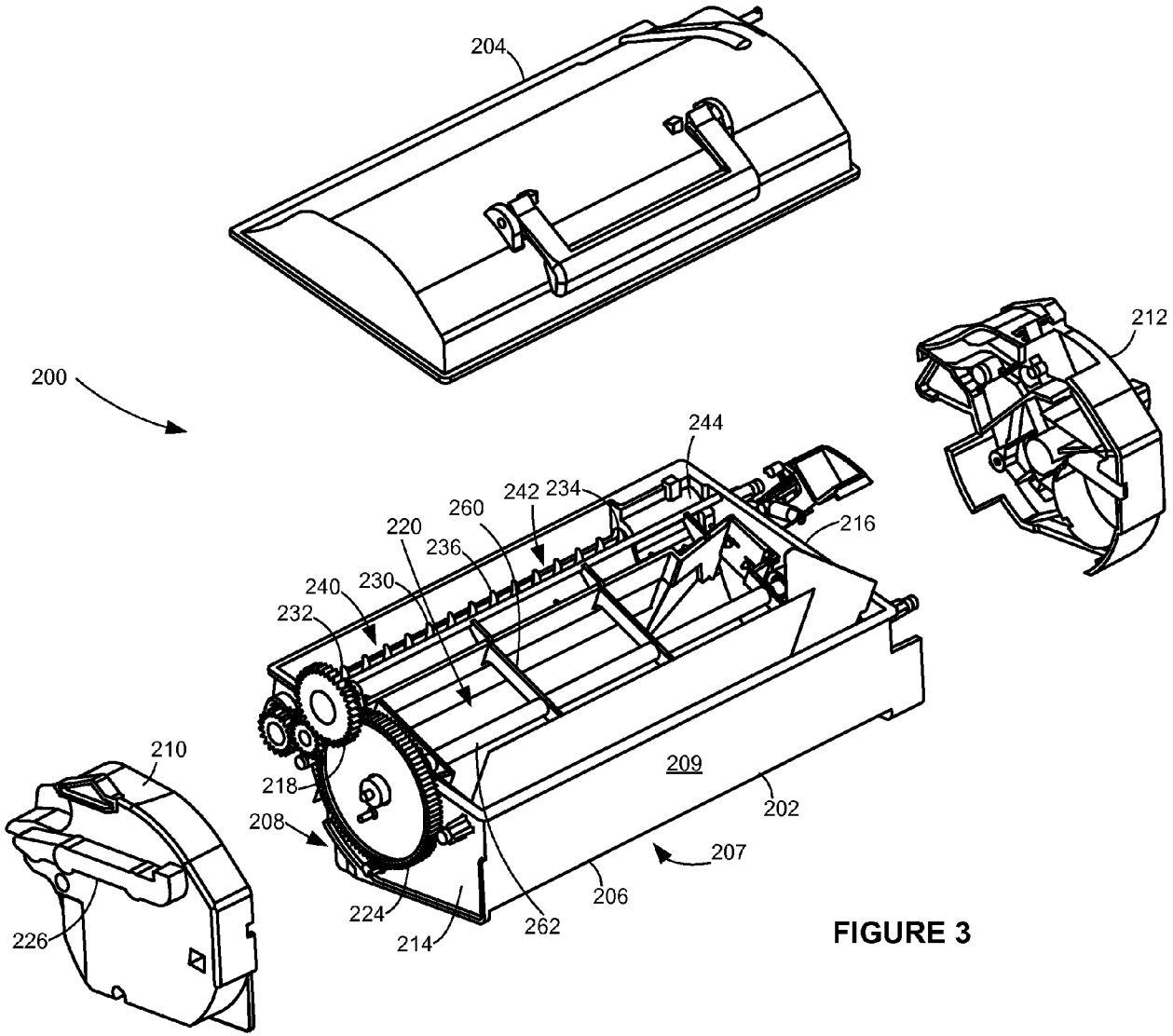
FIG. 3 is an exploded view of the toner cartridge shown in FIG. 2.

Referring now to FIG. 3, toner cartridge 200 includes a housing 202 having an enclosed reservoir 220 for holding a quantity of toner therein. Housing 202 may be viewed as having a top or lid 204 mounted on a base 206. Base 206 is formed by first and second side walls 214, 216 connected to adjoining front and rear walls 208, 209 and bottom 207. First and second end caps 210, 212 are mounted to side walls 214, 216, respectively. First and second end caps 210, 212 each include a guide 226 to assist the insertion of toner cartridge 200 into image forming device 22 for mating with developer unit 301. Various gears are housed within a space formed between first end cap 210 and first side wall 214. At least a portion of a main interface gear 218 is exposed between first end cap 210 and first side wall 214 at the front of toner cartridge 200 to allow main interface gear 218 to engage with a drive system in image forming device 22 that provides torque to main interface gear 218. As a result, first side wall 214 may be referred to as the "drive" or "driven" side of toner cartridge 200. Various interlocks and/or linkages may be housed within the space formed between second end cap 212 and second side wall 216. A paddle 260 is rotatably mounted within toner reservoir 220. First and second ends of a drive shaft 262 of paddle 260 extend through aligned openings (not shown) in first and second side walls 214, 216, respectively. A drive gear 224 is provided on the first end of drive shaft 262 that engages with main interface gear 218 either directly or via one or more intermediate gears.

A channel 240 extends along the width of front wall 208 between first and second side walls 214, 216. Channel 240 is generally horizontal when toner cartridge 200 is installed in image forming device 22. An auger 230 having first and second ends 232, 234, and a spiral screw flight 236 is positioned within and extends along the length of channel 240. First end 232 of auger 230 extends through a bushing 238 (FIG. 7) in first side wall 214. A drive gear (not shown) is positioned on first end 232 of auger 230 that engages with main interface gear 218 either directly or via one or more intermediate gears.

Figure 4:
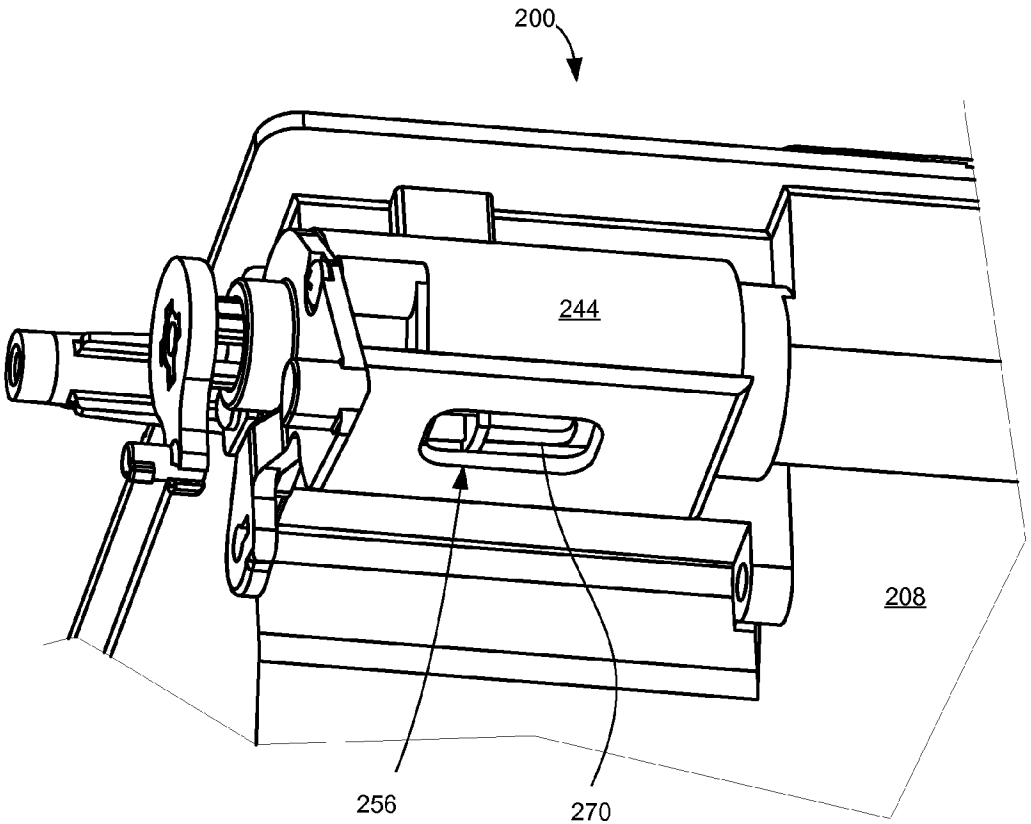
FIG. 4 is a perspective view of a toner exit port of the toner cartridge shown in FIG. 2.

Channel 240 includes an open portion or trough 242 and a substantially enclosed portion 244. Trough 242 is open to toner reservoir 220 and extends from first side wall 214 toward second side wall 216. Enclosed portion 244 of channel 240 extends from second side wall 216 and encloses second end 234 of auger 230. As paddle 260 rotates, it delivers toner from toner reservoir 220 into trough 242. With reference to FIGS. 3 and 4, auger 230 is rotated via the drive gear (not shown) on first end 232 of auger 230 to deliver toner received in channel 240 to a shutter 270 housed in enclosed portion 244 of channel 240. Shutter 270 regulates whether toner is permitted to exit toner cartridge 200 through an exit port 256 provided in front wall 208 and shown in FIG. 4. Exit port 256 is disposed at the bottom of channel 240 so that gravity will assist in exiting toner through exit port 256.

Figure 5:
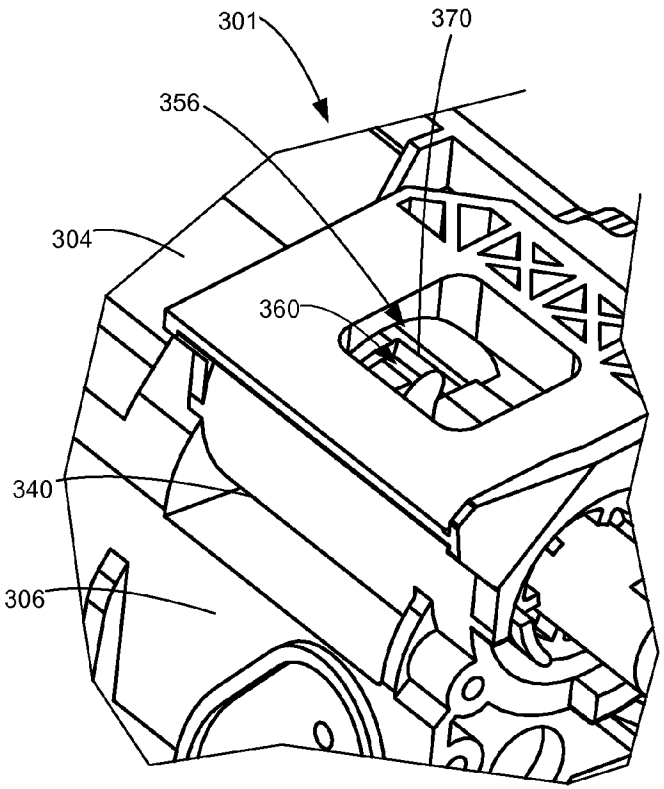
FIG. 5 is a perspective view of a toner entrance port of a developer unit of the imaging unit shown in FIG. 2.
Figure 6:
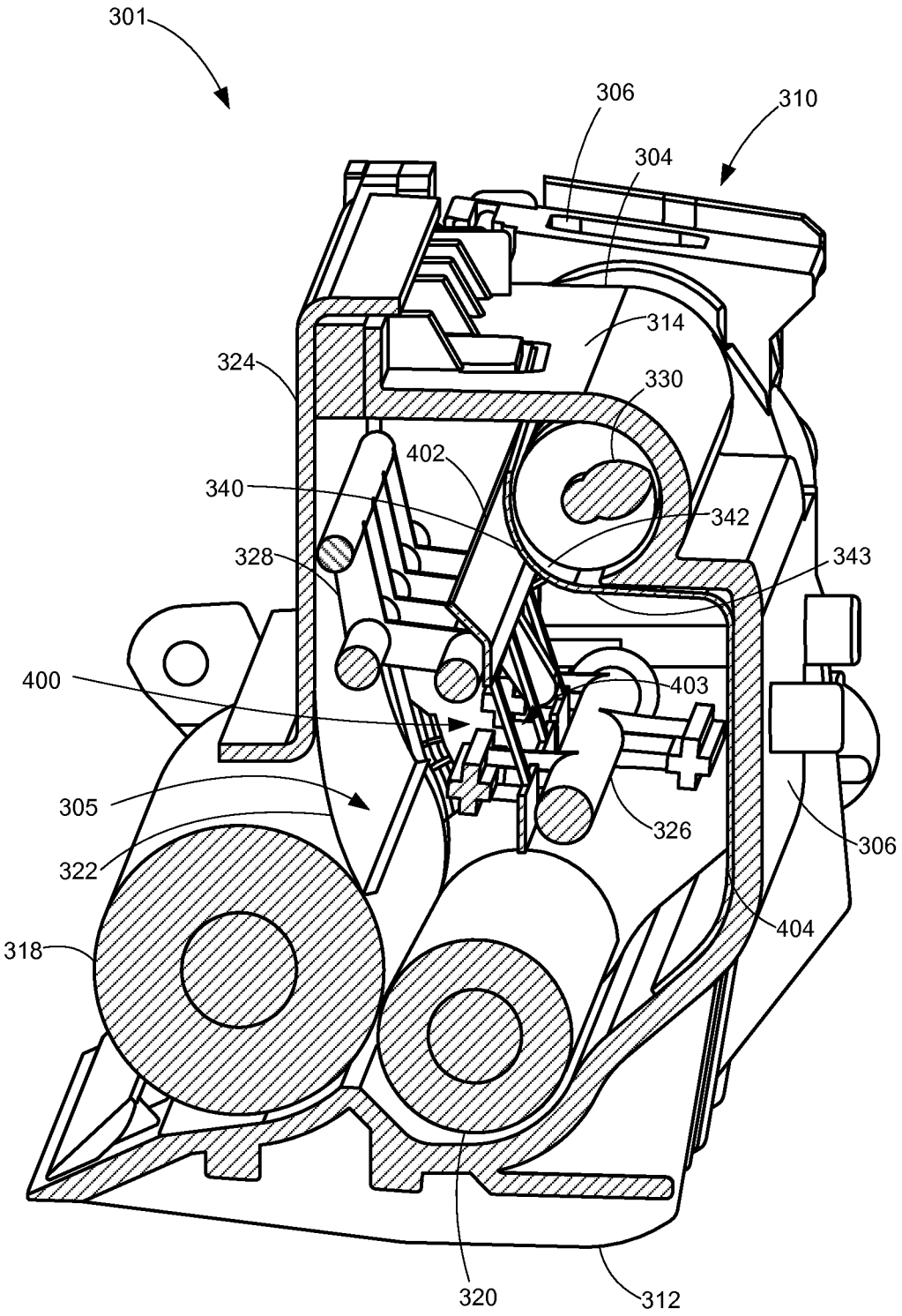
FIG. 6 is a cutaway view of the developer unit shown in FIG. 2.

With reference to FIGS. 5 and 6, developer unit 301 includes a housing 304 enclosing a toner sump 305 sized to hold a quantity of toner. Toner sump 305 is formed by a rear wall 306, first and second side walls 308, 310 (FIG. 7), a bottom 312 and a top 314. FIG. 6 shows a cutaway view of developer unit 301 through a side portion of housing 304 to more clearly illustrate the internal components of developer unit 301. Cleaner unit 302, which would be positioned in front of developer unit 301 (i.e., to the left in FIG. 6), and frame 303 are not shown. A developer roll 318 and a toner adder roll 320 are mounted within toner sump 305. Toner adder roll 320 moves toner supplied to toner sump 305 by toner cartridge 200 to developer roll 318. A doctor blade 322 is disposed along and engages with developer roll 318 to provide a substantially uniform layer of toner on developer roll 318 for subsequent transfer to a latent image on the photoconductive drum in cleaner housing 302. In the example embodiment illustrated, doctor blade 322 is mounted on a bracket 324, e.g., by spot welds. Bracket 324 is attached to housing 304, e.g., by suitable fasteners. One or more agitators, such as agitators 326, 328, may be provided within toner sump 305 to stir and move the toner therein to prevent the toner particles from forming larger clumps.

Figure 7:
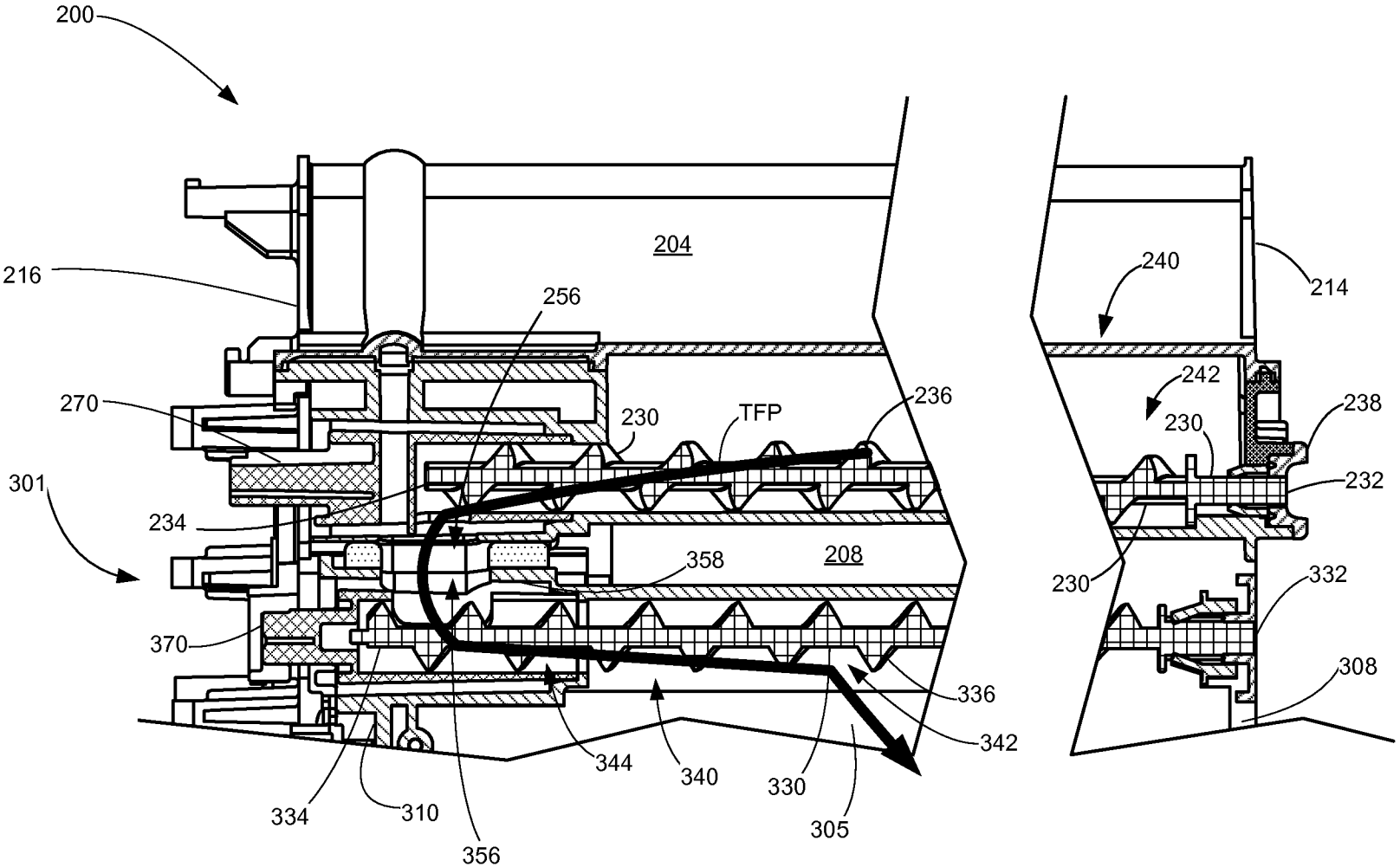
FIG. 7 is a cutaway view of the exit port of the toner cartridge of FIG. 4 in communication with the entrance port of the developer unit of FIG. 5.

With reference to FIGS. 6 and 7, a channel 340 extends along the width of and near the top of rear wall 306. An auger 330 having first and second ends 332, 334 and a spiral screw flight 336 is positioned within and extends along the length of channel 340. First end 332 of auger 330 extends through first side wall 308. A drive gear (not shown) is positioned on first end 332 of auger 330 that engages with input coupler 350 of developer unit 301 either directly or via one or more intermediate gears. Channel 340 includes an open portion or trough 342 and a substantially enclosed portion 344. Trough 342 is open to toner sump 305 and extends from first side wall 308 toward second side wall 310. Enclosed portion 344 of channel 340 extends from second side wall 310 and encloses second end 334 of auger 330.

As shown in FIGS. 5 and 6, an entrance port 356 is provided through top 314 and feeds into enclosed portion 344 of channel 340. Entrance port 356 of developer unit 301 aligns with exit port 256 of toner cartridge 200 when toner cartridge 200 is installed on frame 303 and mated with imaging unit 300. A shutter 370 positioned in enclosed portion 344 of channel 340 regulates whether toner is permitted to enter developer unit 301 through entrance port 356. Shutters 270, 370 of toner cartridge 200 and developer unit 301 are moved from closed positions to open positions as toner cartridge 200 is mated with imaging unit 300 to allow toner to flow from toner cartridge 200 to developer unit 301. Shutters 270, 370 are moved from open positions to closed positions as toner cartridge 200 is separated from imaging unit 300 in order to prevent toner leakage from toner cartridge 200 or developer unit 301. As shown in FIG. 7, second end 334 of auger 330 extends into shutter 370 allowing auger 330 to distribute the incoming toner along channel 340. Trough 342 includes a plurality of openings (not shown) spaced along its length. The openings extend through a bottom portion 343 of trough 342. Auger 330 is rotated via the drive gear on first end 332 of auger 330 to distribute toner received from exit port 256 of toner cartridge 200 along the length of channel 340. The openings in trough 342 allow incoming toner to be distributed substantially evenly into toner sump 305. Trough 342 is disposed above toner sump 305 allowing the entering toner to drop into toner sump 305.

Developer unit 301 also includes a toner level sensing system that measures the amount of toner present in toner sump 305. As discussed in greater detail below, the toner level sensing system determines when toner sump 305 needs to replenished with toner from reservoir 220 of toner cartridge 200. The toner level sensing system also determines when no usable toner remains in toner cartridge 200 rendering toner cartridge 200 empty for practical purposes.

In the example embodiment illustrated in FIG. 6, the toner level sensing system includes a capacitive toner level sensor 400 that uses multiple electrically conductive plates to measure the relative toner levels contained in toner sump 305. In this embodiment, an electrically conductive plate 402 spans laterally across a central region of toner sump 305. Conductive plate 402 forms a first electrode of capacitive toner level sensor 400. In the example embodiment illustrated in FIG. 6, a second electrode is formed by channel 340 and an electrically conductive plate 404 disposed along rear wall 306 of toner sump 305. Conductive plate 404 and channel 340 may be formed from a single sheet of metal. A third electrode is formed by an electrically conductive doctor blade 322 disposed on the opposite side of toner sump 305 from conductive plate 404 and channel 340 such that conductive plate 402 is positioned between doctor blade 322 and the combination of channel 340 and conductive plate 404. The three electrodes form three plates of the capacitive sensor. The three plates form two parallel connected capacitors whose capacitance varies in response to the amount of toner existing between corresponding electrodes of the two capacitors. Conductive plate 402 serves as a sense plate for sensing a capacitance value, indicating the toner level within toner sump 305. Specifically, the capacitance value sensed by conductive plate 402 can be converted to a quantity of toner held in toner sump 305 (for example, in mass units of toner) using an empirically derived correlation. In one embodiment, doctor blade 322 and the combination of channel 340 and conductive plate 404 are electrically coupled together and driven by a common signal source, such as an AC voltage signal source. Alternatively, channel 340 and conductive plate 404 may be electrically insulated from doctor blade 322 and driven by separate voltage signal sources. As shown in FIG. 6, conductive sense plate 402 may be positioned adjacent agitator 326 and may have one or more slots 403 formed through a body thereof to allow agitator 326 to pass through.

Of course the conductive plates of capacitive toner level sensor 400 may take many different shapes and forms as desired and are not limited to those presented in the example embodiment shown in FIG. 6. Further, the toner level sensing system may include any of a number of alternative toner level sensing systems known in the art other than a capacitive toner level sensor. For example, an optical sensor arrangement may be used to sense the toner level in toner sump 305 as described in U.S. Pat. No. 6,496,662 entitled "Optical Toner Low Sensor." Another example is the use of a toner agitator having a torque sensitive coupling and an encoded device coupled thereto as described in U.S. Pat. No. 5,634,169 entitled "Multiple Function Encoder Wheel for Cartridges Utilized in an Electrophotographic Output Device." Further, although less accurate, the number of rotations of a component such as developer roll 318 or the photoconductive drum in cleaner unit 302 may be tracked to estimate the amount of toner remaining in toner sump 305.

During operation, when the toner level sensing system determines that the toner level in toner sump 305 is below a predetermined threshold deemed "low," controller 28 initiates a toner addition cycle. FIG. 7 illustrates the toner flow path (shown as the solid arrow labeled "TFP") between toner cartridge 200 and developer unit 301. During a toner addition cycle, main interface gear 218 is driven by a corresponding drive gear in image forming device 22 to rotate paddle 260 and auger 230. The rotation of paddle 260 pushes toner from reservoir 220 into channel 240 where auger 230 is positioned. Auger 230 then advances the toner through shutter 270 and out exit port 256. The toner falls via gravity from exit port 256 into entrance port 356 of developer unit 301. The toner is passed through shutter 370 into enclosed portion 344 of channel 340. Input coupler 350 is driven by a corresponding drive element in image forming device 22 to rotate auger 330 as well as agitator 326, toner adder roll 320 and developer roll 318. The rotation of auger 330 distributes toner along channel 340. The toner then drops through the openings in trough 342 into toner sump 305 where it is held for use by developer unit 301.

In one embodiment, during each toner addition cycle, auger 230 in toner cartridge 200 is rotated a predetermined amount in order to transfer a predetermined amount of toner from toner cartridge 200 to developer unit 301. Auger 330 in developer unit 301 is rotated simultaneously with auger 230 in order to distribute the toner entering developer unit 301 along channel 340 as it enters. Auger 330 may also be rotated a preset amount after auger 230 is stopped in order to ensure that the entering toner properly distributes along channel 340 and falls through the holes in bottom 343 of trough 342 into toner sump 305 for use by developer roll 318. In one embodiment, auger 330 rotates faster than auger 230 in order to prevent the toner entering entrance port 356 from clogging. As the toner level in reservoir 220 of toner cartridge 200 gets low, the flow rate of the toner exiting toner cartridge 200 decreases for a given rotational speed of auger 230. As a result, when the toner level in reservoir 220 is low, the rotational speed of auger 230 may be increased and/or the number of rotations of auger 230 may be increased for each toner addition cycle in order to deliver the same amount of toner from toner cartridge 200 to developer unit 301 per toner addition cycle as when toner cartridge 200 is full.

The toner additional cycle is repeated each time the toner level in toner sump 305 falls below the predetermined "low" threshold until reservoir 220 in toner cartridge 200 runs out of usable toner. The toner level sensing system indicates when toner cartridge 200 runs out of usable toner. Specifically, after each toner addition cycle, the toner level sensing system determines the toner level in toner sump 305. If after a toner addition cycle the toner level sensing system finds that toner sump 305 has not been refilled to the level anticipated, the toner level sensing system concludes that toner cartridge 200 is out of usable toner. In one embodiment, controller 28 counts the printable elements (pels) printed with toner cartridge 200. This value is determined based on the pels printed regardless of the number of toner addition cycles or revolutions of auger 230. Accordingly, pels may be counted for toner cartridge 200 even before toner has actually been moved from toner cartridge 200 to developer unit 301 if toner sump 305 was relatively full when toner cartridge 200 was installed. Controller 28 uses the pel count to confirm the toner level sensing system's determination that toner cartridge 200 is out of usable toner. Specifically, in this embodiment, when the toner level sensing system determines that toner cartridge 200 has run out of usable toner, controller 28 checks to see how many pels have been printed with toner cartridge 200. If the pel count is below a predetermined threshold indicating that toner cartridge 200 is near the end of its toner supply, controller 28 concludes that toner cartridge 200 is out of usable toner. If, on the other hand, the pel count is above the predetermined threshold indicating that toner cartridge 200 should have additional toner remaining, controller 28 concludes that an error must have occurred (e.g., toner clogging, toner cartridge 200 or imaging unit 300 not installed properly) and displays an error message to the user on user interface 36 and/or display monitor 64. The pel count may also be stored in memory associated with processing circuitry 45 of toner cartridge 200 so that the count will travel with toner cartridge 200 if toner cartridge 200 is moved to a different image forming device 22.

Once toner cartridge 200 runs out of usable toner it must be replaced or refilled. However, when toner cartridge 200 runs out of usable toner, a buffer amount of toner remains in toner sump 305. The toner remaining in toner sump 305 allows image forming device 22 to continue printing even though no usable toner remains in toner cartridge 200. Image forming device 22 can continue printing until toner sump 305 runs out of usable toner. In this manner, toner sump 305 provides the user with a window to replace toner cartridge 200 without wasting toner. In one example embodiment, the predetermined threshold amount of toner in toner sump 305 used to trigger each toner addition cycle is between about 50 g and about 60 g of toner to ensure that sufficient toner remains in toner sump 305 after toner cartridge 200 runs out of usable to toner to allow image forming device 22 to continue printing for a limited time. In one embodiment, about 5 g of toner is transferred to toner sump 305 from toner cartridge 200 during each toner addition cycle.

In order to help the user determine when to replace toner cartridge 200, when toner cartridge 200 runs out of usable toner as determined by the failure to replenish toner sump 305 during a toner addition cycle, controller 28 displays a page countdown on user interface 36 of image forming device 22 and/or display monitor 64 of computer 24. The page countdown informs the user of the number of pages (decremented in single page increments) that may be printed before toner sump 305 will run out of the buffer amount of toner. It will be understood that if duplex printing is performed by image forming device 22 (where images are printed on both sides of a media sheet), the number of "pages" remaining actually refers to the number of printed sides of media remaining and that each duplex sheet printed consists of two "pages." In addition to the page countdown, controller 28 may also display a notification that toner cartridge 200 is "empty" or "very low" when toner cartridge 200 runs out of usable toner. Further, when the usable toner remaining in reservoir 220 of toner cartridge 200 falls below a predetermined threshold determined by the number of pels printed with toner cartridge 200 but before toner cartridge 200 runs out of usable toner, controller 28 may display a notification or warning to the user that toner cartridge 200 is "low."

Figure 8:
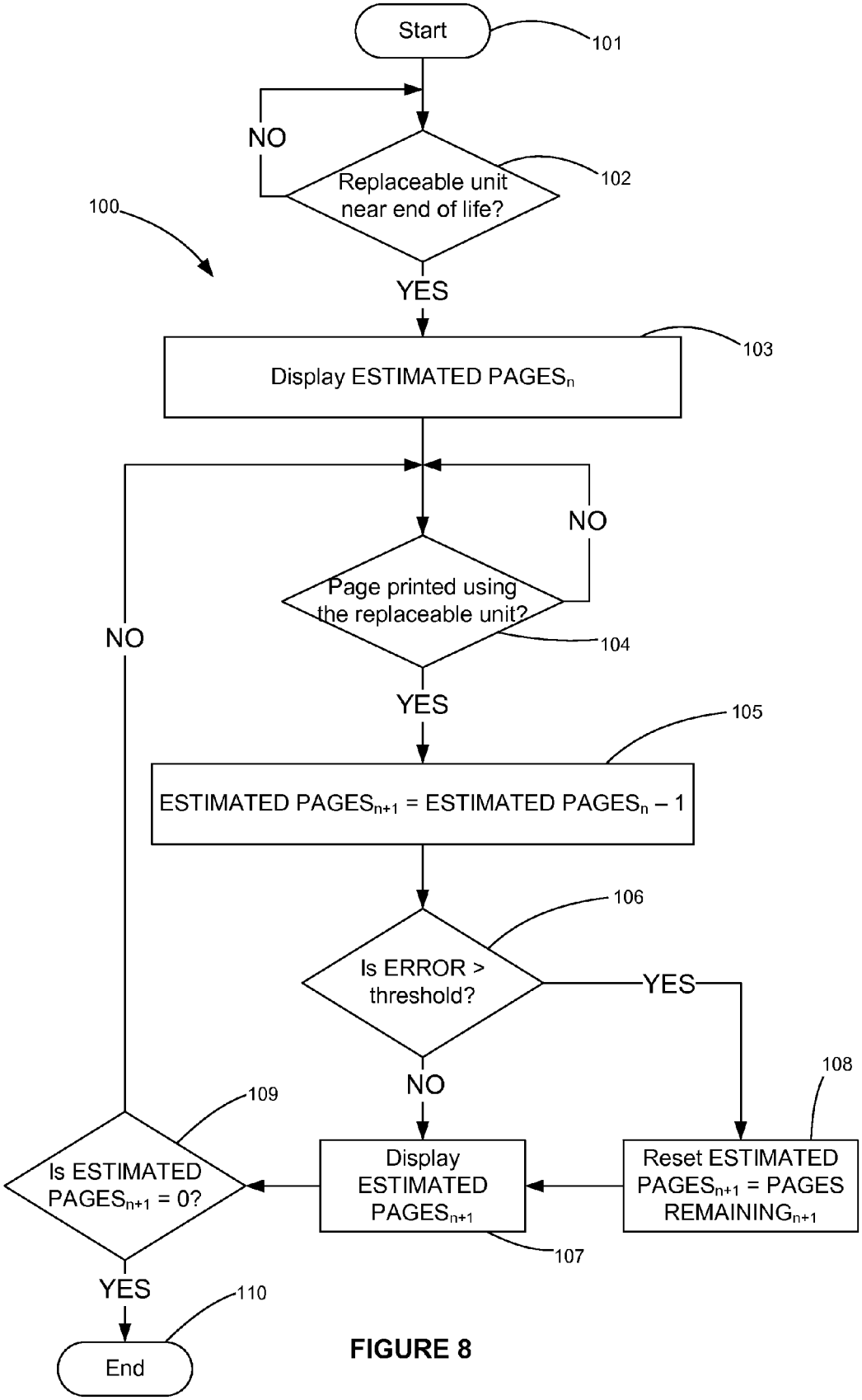
FIG. 8 is a flowchart showing a method for displaying a page countdown for a replaceable unit of an image forming device according to one example embodiment.

With reference to FIG. 8, a method 100 for providing the page countdown for a replaceable unit such as toner cartridge 200 is shown according to one example embodiment. The method begins at step 101. At step 102, controller 28 determines whether the replaceable unit is near the end of its life. Toner cartridge 200 is deemed near the end of its life when it runs out of usable toner as detected by the toner level sensing system in toner sump 305. As discussed above, when toner cartridge 200 runs out of usable toner, a buffer amount of toner remains in toner sump 305 to allow image forming device 22 to continue printing until the toner in toner sump 305 is depleted. However, if toner sump 305 runs out of usable toner, toner cartridge 200 must be replaced in order to resupply toner sump 305.

At step 103, controller 28 displays an estimate of the number of pages remaining (Estimated Pages) on user interface 36 (and/or display monitor 64). In one embodiment, the number of pages remaining is determined using the number of pels printed with toner cartridge 200. The number of pels printed is converted to an amount of toner (e.g., in grams) (Supply Used) using an empirically derived correlation based on the type of toner used and the darkness setting of image forming device 22 for the print operation (i.e., if the print setting is darker, more toner will be used per pel). The amount of toner used can be subtracted from the initial toner supply in toner cartridge 200 less an estimate of the amount of unusable toner initially supplied in toner cartridge 220 (Supply Limit) to determine the amount of toner remaining in toner cartridge 200 (Supply Remaining) per the following Equation 1:

$$\text{Supply Remaining}=\text{Supply Limit}-\text{Supply Used} \quad (1)$$

The Supply Remaining can then be divided by the average toner used per page for toner cartridge 200 or image forming device 22 (Avg Supply Usage per Page) to determine the number of pages remaining (Pages Remaining) per the following Equation 2:

$$\text{Pages Remaining}=\text{Supply Remaining}/\text{Avg Supply Usage per Page} \quad (2)$$

The average toner used per page may be calculated for the entire life of toner cartridge 200 or image forming device 22 or a rolling average of a fixed number of pages (e.g., the last 1,000 or the last 2,000 pages printed) may be used instead. The average toner used per page may be calculated as a true average (i.e., the amount of toner used for a given number of pages divided by the number of pages) or the average toner used per page may be calculated using a mathematical estimate such as, for example a low pass filter equation that simulates a rolling average. Further, a default average toner used per page may be used as a starting point or for a predetermined number of pages at the beginning of the life of toner cartridge 200 or image forming device 22.

When controller 28 first determines that toner cartridge 200 is near the end of its life, before additional pages are printed, the Estimated Pages displayed is set to equal the Pages Remaining.

In addition to displaying the number of pages remaining after toner cartridge 200 is out of usable toner, controller 28 may also display the number of pages remaining prior to toner cartridge 200 running out of usable toner. The number of pages displayed prior to toner cartridge 200 running out of usable toner may be rounded as desired (e.g., to the nearest hundred pages, to the nearest thousand pages, etc.). However, the number of pages remaining prior to toner cartridge 200 running out of usable toner may be of limited value to the user given that the value may be quite high (e.g., on the order of thousands or tens of thousands of pages remaining) early in the life of toner cartridge 200. Alternatively, controller 28 may display a percentage of toner remaining (% Supply Remaining) prior to toner cartridge 200 running out of usable toner using the following Equation 3:

$$\%\ \text{Supply Remaining}=(\text{Supply Remaining}/\text{Supply Limit})*100 \quad (3)$$

Of course the percentage of toner remaining may also be rounded as desired (e.g., to the nearest percent, to the nearest five percent, to the nearest ten percent, etc.).

In one embodiment, when controller 28 first determines that toner cartridge 200 is near the end of its life, before additional pages are printed, the Supply Used value is reset to zero and the Supply Limit value is reset to a predetermined value that represents an estimate of the amount of toner remaining in toner sump 305 when toner cartridge 200 runs out of usable toner sufficient to ensure that toner sump 305 will not run out of usable toner before the page countdown reaches zero. At this time, the Supply Remaining and Pages Remaining values are calculated using these reset Supply Used and Supply Limit values and the Estimated Pages is set to equal the Pages Remaining. As additional pages are printed after toner cartridge 200 is out of usable toner, the number of pels printed after toner cartridge 200 reached the near end of life state at step 102 is used to determine the Supply Used value. Accordingly, in this embodiment, the Supply Used value represents the amount of toner used after toner cartridge 200 runs out of usable toner. After toner cartridge 200 runs out of usable toner, the Supply Remaining and Pages Remaining values are then determined using the reset Supply Limit value and the Supply Used values that represent the amount of toner used after toner cartridge 200 runs out of usable toner. In one embodiment, the Supply Limit value used after toner cartridge 200 runs out of usable toner is between about 5 g and about 10 g of toner.

Other performance metrics may be used instead of or in combination with the number of pels printed with toner cartridge 200 to determine the Supply Used. For example, the amount of toner used may be determined using: a measure of the toner used as determined by the toner level sensing system in toner sump 305, the number of toner addition cycles completed, the number of toner addition cycles started, the number of revolutions of auger 230, the number of revolutions of auger 330 and/or the number of pages printed with toner cartridge 200.

Each time image forming device 22 prints a page as determined at step 104, the Estimated Pages displayed decreases by one page until the number of pages remaining is zero regardless of the amount of toner used to print each page unless a cumulative error value based on the amount of toner used exceeds a predetermined threshold. The error value measures a discrepancy between the number of pages displayed and the calculated number of pages remaining. The error threshold may be stored in memory associated with processing circuitry 45 of toner cartridge 200 so that the threshold value will travel with toner cartridge 200 if toner cartridge 200 is moved to a different image forming device 22. If the cumulative error value exceeds the predetermined threshold, the number of pages remaining is modified to reflect the amount of toner remaining. In order to maximize the perceived reliability of the displayed page countdown by the user, it is desired to decrement the displayed number of pages remaining by one with each page printed unless a change in the average toner usage per page necessitates a modification. If instead the displayed number of pages remaining was modified frequently such as by not decreasing the displayed number of pages remaining when a page is printed or by frequently decreasing the displayed number of pages remaining by more than one page when a page is printed, the user may tend to interpret the page countdown as unreliable. Modification to the number of pages remaining may be necessary where a higher amount of toner is used per page after toner cartridge 200 is out of usable toner than the Avg Supply Usage per Page, otherwise less toner may be available in toner sump 305 than the displayed number of pages remaining.

The error value (Error) may be calculated by the difference between the displayed number of pages remaining multiplied by the average usage per page and the actual toner remaining as determined by the number of pels printed per the following Equation 4:

$$\text{Error}=(\text{Estimated Pages}*\text{Avg Supply Usage per Page})-\text{Supply Remaining} \quad (4)$$

FIG. 8 illustrates this operation. At step 105, the Estimated Pages is reduced by one for each page printed. At step 106, controller 28 determines whether the cumulative Error value exceeds the predetermined threshold. If the cumulative Error value does not exceed the predetermined threshold, the Estimated Pages remaining is displayed at step 107. If instead the cumulative Error value exceeds the predetermined threshold, at step 108 the Estimated Pages is replaced with the Pages Remaining as calculated in Equation 2 above and the new value for the Estimated Pages is displayed at step 107. Once the Estimated Pages reaches zero as determined at step 109, it is determined that toner sump 305 is out of usable toner and toner cartridge 200 must be replaced ending the page countdown at step 110.

Table 1 below shows an example of the page countdown where after toner cartridge 200 is out of usable toner printing is performed at approximately six times the print darkness as compared to the print darkness prior to toner cartridge 200 running out of usable toner. In the example shown in Table 1, the Error threshold used to reset the Estimated Pages is 2000 mg of toner and the Avg Supply Usage per Page at Page 0 is 22 mg of toner per page. In this example, Page 0 represents the time at which toner cartridge 200 has run out of usable toner and the Supply Limit value has been reset to 5000 mg of toner and the Supply Used value has been reset to 0 mg of toner.

TABLE 1

| Page | Supply Used for the Page | Supply Remaining | No. of Pages Displayed | Cumulative Error (mg) |
|---|---|---|---|---|
| 0 | 0 | 5000 | 227 | 0 |
| 1 | 86 | 4914 | 226 | 64 |
| 2 | 78 | 4836 | 225 | 120 |
| 3 | 141 | 4695 | 224 | 239 |
| 4 | 131 | 4564 | 223 | 348 |
| 5 | 143 | 4421 | 222 | 469 |
| 6 | 160 | 4261 | 221 | 607 |
| 7 | 184 | 4077 | 220 | 769 |
| 8 | 69 | 4008 | 219 | 816 |
| 9 | 130 | 3878 | 218 | 924 |
| 10 | 119 | 3759 | 217 | 1021 |
| 11 | 161 | 3598 | 216 | 1160 |
| 12 | 158 | 3440 | 215 | 1296 |
| 13 | 181 | 3259 | 214 | 1455 |
| 14 | 91 | 3168 | 213 | 1524 |
| 15 | 75 | 3093 | 212 | 1577 |
| 16 | 109 | 2984 | 211 | 1664 |
| 17 | 133 | 2851 | 210 | 1775 |
| 18 | 118 | 2733 | 209 | 1871 |
| 19 | 166 | 2567 | 208 | 2015 |
| 20 | 175 | 2392 | 109 | 6 |
| 21 | 179 | 2213 | 108 | 163 |
| 22 | 85 | 2128 | 107 | 226 |
| 23 | 189 | 1939 | 106 | 393 |
| 24 | 83 | 1856 | 105 | 454 |

As shown in Table 1, in this example, the page countdown is reset after the twentieth page when the cumulative Error exceeds the threshold (2000 mg). It will be appreciated that the example shown in Table 1 represents an exaggerated increase in the average toner usage per page that accumulates Error at a rate far greater than is expected during actual usage. The example shown in Table 1 is merely intended to illustrate how the cumulative error is tracked and how the displayed pages remaining value is reset when the cumulative error exceeds a predetermined threshold.

As discussed above, toner cartridge 200 and imaging unit 300 are insertable into and removable from image forming device 22. Toner cartridge 200 and/or imaging unit 300 may be moved from one image forming device 22 to another at various times during their lives. In order to account for possible movement of toner cartridge 200 and imaging unit 300 between image forming devices 22, once controller 28 determines that toner cartridge 200 has run out of usable toner, controller 28 records that toner cartridge 200 is "near end of life" in memory associated with processing circuitry 45 on toner cartridge 200 and processing circuitry 44 on imaging unit 300. Further, in order to enable the page countdown to continue in a new image forming device 22, controller 28 also records the Supply Used, Supply Limit, Estimated Pages, Pages Remaining, Avg Supply Usage per Page and the cumulative Error values associated with toner cartridge 200 in the memory associated with both processing circuitry 45 on toner cartridge 200 and processing circuitry 44 on imaging unit 300.

If a toner cartridge 200 near end of life is mated with a different imaging unit 300 not already marked as being associated with a toner cartridge near end of life (either in a different image forming device 22 or in the same image forming device 22), controller 28 records that toner cartridge 200 is near end of life in processing circuitry 44 of the new imaging unit 300. Since toner cartridge 200 near the end of life is out of usable toner, the number of pages remaining depends on the amount of toner in toner sump 305. Further, since the new imaging unit 300 was not associated with a toner cartridge near end of life when mated with toner cartridge 200, it is assumed that at least the "low" level of toner that would initiate a toner addition cycle is present in toner sump 305 of the new imaging unit 300. As a result, the new imaging unit 300 possesses at least enough toner to fulfill the remainder of the page countdown associated with toner cartridge 200. Accordingly, upon being mated with the new imaging unit 300, the page countdown for toner cartridge 200 continues where it left off. In this manner, the page countdown associated with toner cartridge 200 travels with the cartridge.

If instead a toner cartridge 200 near end of life is mated with a different imaging unit 300 that is already marked as being associated with a toner cartridge near end of life (either in a different image forming device 22 or in the same image forming device 22), controller 28 determines whether the Pages Remaining value stored in the memory associated with processing circuitry 45 of toner cartridge 200 is greater than or less than the Pages Remaining value stored in the memory associated with processing circuitry 44 of the new imaging unit 300 from its previous toner cartridge. If the Pages Remaining value associated with toner cartridge 200 is less than or equal to the Pages Remaining value associated with the new imaging unit 300 from its previous toner cartridge, it is assumed that at least enough toner is present in toner sump 305 of the new imaging unit 300 to fulfill the remainder of the page countdown associated with toner cartridge 200. Accordingly, the Pages Remaining value associated with imaging unit 300 is reset to match the Pages Remaining value associated with toner cartridge 200 and the page countdown for toner cartridge 200 continues where it left off. In this manner, the page countdown associated with toner cartridge 200 once again travels with the cartridge. If, on the other hand, the Pages Remaining value associated with toner cartridge 200 is greater than the Pages Remaining value associated with the new imaging unit 300 from its previous toner cartridge, it is assumed that the new imaging unit 300 does not possess enough toner to fulfill the remainder of the page countdown associated with toner cartridge 200. Accordingly, the Pages Remaining value associated with toner cartridge 200 is reset to match the Pages Remaining value associated with imaging unit 300 from its previous toner cartridge and the page countdown for toner cartridge 200 continues from where the page countdown of the toner cartridge previously associated with imaging unit 300 left off. This prevents toner sump 305 of the new imaging unit 300 from being depleted before the page countdown reaches zero.

If an imaging unit 300 marked as being associated with a toner cartridge near end of life is mated with a different toner cartridge 200 not near end of life (either in a different image forming device 22 or in the same image forming device 22), it is assumed that usable toner remains in the new toner cartridge 200. As a result, controller 28 clears the cartridge near end of life designation from processing circuitry 44 of imaging unit 300 and initiates a toner addition cycle to replenish toner sump 305. Toner addition cycles are then performed whenever the toner level in toner sump 305 falls below the predetermined threshold as discussed above.

Replaceable units in image forming device 22 other than toner cartridge 200 also requirement replacement during the course of the useful life of image forming device 22. For example, the imaging components housed in imaging unit 300, such as the photoconductive drum in cleaner unit 302, developer roll 320 and toner adder roll 318, wear over the life of imaging unit 300 requiring periodic replacement of imaging unit 300, although the replacement of imaging unit 300 generally occurs with less frequency than the replacement of toner cartridge 200. Further, imaging unit 300 may require replacement when the storage of the waste toner removal system in cleaner unit 302 fills. Similarly, the components making up fuser 37 wear over its life requiring periodic replacement of fuser 37, again with less frequency than toner cartridge 200.

Method 100 shown in FIG. 8 may be applied to these other replaceable units as well. For example, in one embodiment, controller 28 displays a page countdown on user interface 36 and/or display monitor 64 to indicate the number of pages that may be printed before imaging unit 300 will require replacement. Like the page countdown associated with toner cartridge 200, the page countdown associated with imaging unit 300 decrements in single page increments unless a cumulative error value exceeds a predetermined threshold. The page countdown associated with imaging unit 300 is displayed once one or more performance metrics associated with imaging unit 300 satisfy a predetermined threshold deemed "near the end of life." The page countdown associated with imaging unit 300 may also be displayed prior to the near end of life state as desired. The number of pages remaining until imaging unit 300 needs to be replaced may be determined using one or more performance metrics associated with the life of imaging unit 300 such as the number of pages printed using imaging unit 300, an estimate of the amount of toner transferred to the storage of the waste toner removal system in cleaner unit 302, the number of revolutions of the photoconductive drum in cleaner unit 302, the number of revolutions of auger 330 and/or the number of pels printed with imaging unit 300. The amount of toner transferred to the storage of the waste toner removal system in cleaner unit 302 may be estimated using an empirically derived correlation based on the type of toner used, the print darkness and the number of revolutions of the photoconductive drum in cleaner unit 302.

In one example embodiment, the number of pages remaining for imaging unit 300 is determined using three performance metrics: the number of pages printed using imaging unit 300, the number of revolutions of the photoconductive drum and the amount of toner transferred to the storage of the waste toner removal system. In this embodiment, each of the three performance metrics has its own Supply Limit, Supply Used and Supply Remaining value. In one embodiment, the Supply Limit for the toner transferred to the storage of the waste toner removal system is between about 100 g of toner and about 150 g of toner, the Supply Limit for the photoconductive drum revolutions is between about 500,000 revolutions and about 750,000 revolutions and the Supply Limit for the page count is between about 50,000 pages and about 150,000 pages. When the % Supply Remaining (which may be calculated above in Equation 3) for one of the three performance metrics falls below a predetermined threshold (e.g., 1%, 2%, 5%, 10%, etc.), imaging unit 300 is deemed "near the end of life." The Pages Remaining may be determined for each of the three performance metrics associated with imaging unit 300 using Equation 2 above. The Avg Supply Usage per Page may be determined for each performance metric based on a true average or a mathematical estimate for the entire life of imaging unit 300 or as a rolling average as discussed above with respect to toner cartridge 200. When one of the performance metrics reaches the near end of life threshold at step 102, the Estimated Pages value is set to equal the Pages Remaining value for that performance metric and displayed at step 103. As discussed above with respect to toner cartridge 200, at steps 104-110, the number of pages displayed is then decremented by one page for each page printed unless a cumulative error value for the performance metric that reached the near end of life threshold exceeds a predetermined value. Further, in order to account for possible movement of imaging unit 300 between image forming devices 22, controller 28 may record the Supply Used, Supply Limit, Estimated Pages, Pages Remaining, Avg Supply Usage per Page and the cumulative Error values associated with imaging unit 300 and the fact that imaging unit 300 has reached the "near end of life" state in the memory associated with processing circuitry 44 on imaging unit 300.

Table 2 below shows an example of possible values for each of the three performance metrics. In the example shown in Table 2, the threshold for declaring that imaging unit 300 is near the end of its life is 1% of the supply remaining.

TABLE 2

| Performance Metric | Supply Limit | Supply Used | Supply Remaining | % Supply Remaining |
|---|---|---|---|---|
| Toner to cleaner (g) | 100 | 98.6 | 1.4 | 1.4% |
| Photoconductive Drum Revolutions (no. of revs) | 60K | 59,400 | 600 | 1.0% |
| Pages Printed (no. of pages) | 10K | 9,880 | 120 | 1.2% |

As shown in Table 2, in this example, the number of revolutions of the photoconductive drum (1.0%) has reached the near end of life threshold (1%) but the number of pages printed using imaging unit 300 (1.2%) and the amount of toner transferred to the storage of the waste toner removal system (1.4%) have not. As a result, in this example, imaging unit 300 is deemed near the end of its life after photoconductive drum revolution number 59,400. The number of pages displayed is then decremented by one page for each page printed unless a cumulative error value for the number of photoconductive drum revolutions exceeds a predetermined value as determined using Equation 4 above with the Avg Supply Usage per Page representing the average number of photoconductive drum revolutions per page printed.

Further, in one embodiment, controller 28 displays a page countdown on user interface 36 and/or display monitor 64 to indicate the number of pages that may be printed before fuser 37 will require replacement. Like the page countdowns associated with toner cartridge 200 and imaging unit 300, the page countdown associated with fuser 37 decrements in single page increments unless a cumulative error value exceeds a predetermined threshold. The page countdown associated with fuser 37 is displayed once one or more performance metrics associated with fuser 37 satisfy a predetermined threshold deemed "near the end of life." The page countdown associated with fuser 37 may also be displayed prior to the near end of life state as desired. The number of pages remaining until fuser 37 needs to be replaced may be determined using one or more performance metrics associated with the life of fuser 37 such as the number of pages printed using fuser 37, the number of revolutions of a roll or belt of fuser 37 and/or the number of pels printed with fuser 37.

In one example embodiment, the number of pages remaining for fuser 37 is determined using two performance metrics: the number of pages printed using fuser 37 and the number of revolutions of a belt or roll of fuser 37. In this embodiment, both performance metrics have their own Supply Limit, Supply Used and Supply Remaining values. When the % Supply Remaining (calculated above in Equation 3) for one of the performance metrics falls below a predetermined threshold (e.g., 1%, 2%, 5%, 10%, etc.), fuser 37 is deemed "near the end of life." The Pages Remaining may be determined for both of the performance metrics associated with fuser 37 using Equation 2 above. When one of the performance metrics reaches the near end of life threshold at step 102, the Estimated Pages value is set to equal the Pages Remaining value for that performance metric and displayed at step 103. As discussed above with respect to toner cartridge 200 and imaging unit 300, at steps 104-110, the number of pages displayed is then decremented by one page for each page printed unless a cumulative error value for the performance metric that reached the near end of life threshold exceeds a predetermined value. Further, in order to account for possible movement of fuser 37 between image forming devices 22, controller 28 may record the Supply Used, Supply Limit, Estimated Pages, Pages Remaining, Avg Supply Usage per Page and the cumulative Error values associated with fuser 37 and the fact that fuser 37 has reached the "near end of life" state in the memory associated with processing circuitry 46 on fuser 37.

In the example embodiments discussed above, the page countdown for toner cartridge 200 uses one performance metric, the page countdown for fuser 37 uses two performance metrics and the page countdown for imaging unit 300 uses three performance metrics; however, it will be appreciated that one or more than one performance metric may be used for any of these replaceable units. Further, replaceable units other than a toner cartridge, an imaging unit or a fuser may also utilize method 100 to display a page countdown as the replaceable unit nears the end of its life.

It will be appreciated that the configurations and architectures of toner cartridge 200 and imaging unit 300 are merely provided as examples and are not intended as limiting. Other configurations and architectures may be used as desired. For example, in one alternative embodiment, the main toner supply for the image forming device, the developer unit, and the cleaner unit including the photoconductive drum are housed in one replaceable unit. In another embodiment, the main toner supply for the image forming device and the developer unit are provided in a first replaceable unit and the cleaner unit including the photoconductive drum is provided in a second replaceable unit. Further, although the example image forming device 22 discussed above includes one toner cartridge and corresponding imaging unit, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing. Method 100 discussed above may be used as desired to display a page countdown for any of these replaceable units. Further, although the example image forming device 22 discussed above is an electrophotographic printer, the image forming device may utilize other imaging technologies known in the art. For example, in one alternative, the image forming device is a thermal or piezo electric inkjet printer and a page countdown is used according to method 100 as one or more ink tanks or ink cartridges near the end of life.

In another embodiment, a countdown of an estimate of the number of business (or calendar) days remaining before the replaceable unit will require replacement is displayed on user interface 36 and/or output device 62 in addition to or instead of the page countdown. In this embodiment, controller 28 determines an average number of pages printed per business (or calendar) day by image forming device 22. Like the Avg Supply Usage per Page discussed above, the average number of pages printed per business (or calendar) day may be determined based on a true average or a mathematical estimate for the entire life of the replaceable unit or as a rolling average for a portion of the life of the replaceable unit. The Pages Remaining and Estimated Pages values discussed above are converted into a number of business (or calendar) days by dividing the Pages Remaining and Estimated Pages values by the average number of pages printed per business (or calendar) day. The number of days displayed is decremented by one each business (or calendar) day unless a cumulative error value exceeds a predetermined threshold in the same manner as the page countdown discussed above.

Further, in one embodiment, the number of days displayed takes into account the printing patterns of image forming device 22. For example, separate averages may be calculated for the number of pages printed for each day of the week (e.g., a first average number of pages printed on Mondays, a second average number of pages printed on Tuesdays, etc.) and these averages may be used to determine the number of days remaining. Specifically, where a separate average number of pages printed is calculated for each day of the week, the number of days remaining may be calculated by subtracting each daily average from the number of pages remaining and counting the number of days that must be subtracted before the number of pages remaining goes to zero. For example, if 500 pages remain at the end of the day on Monday and the daily averages for Tuesday, Wednesday and Thursday are 150 pages, 250 pages and 400 pages, respectively, then 2 days remain because the number of pages remaining is expected to reach zero on Thursday. In this manner, if a high volume of pages is typically printed on certain days of the week and a low volume of pages is printed on other days of the week, the number of days displayed is modified accordingly. Similarly, the number of days displayed may take into account monthly printing trends (e.g., low printing volume at the beginning of the month and high printing volume at the end of the month) and/or yearly printing trends (e.g., high printing volume near the end of each quarter). Further, holidays or other days where little or no printing occurs or is likely to occur may be discarded from the average(s) calculated in order to prevent these days from skewing the average(s). In addition, rather than displaying the number of days remaining for the replaceable unit, in one embodiment, an estimate of the date on which the replaceable unit will require replacement is displayed. The estimated date of replacement is determined by counting out the number of business (or calendar) days remaining from the current date.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. A method for providing a page countdown for a replaceable unit of an image forming device, comprising:

calculating a number of pages remaining until the replaceable unit will reach the end of its life;

displaying on a display screen of at least one of the image forming device and a device in electronic communication with the image forming device the calculated number of pages remaining until the replaceable unit will reach the end of its life;

after displaying the calculated number of pages remaining, decreasing the displayed number of pages remaining by one for each page printed by the image forming device, recalculating the number of pages remaining and tracking a discrepancy between the displayed number of pages remaining and the recalculated number of pages remaining; and if the discrepancy exceeds a predetermined error threshold, displaying the recalculated number of pages remaining and continuing decreasing the displayed number of pages remaining by one for each page printed from the displayed recalculated number of pages remaining.

2. The method of claim 1, wherein tracking the discrepancy includes tracking a discrepancy accumulated over the course of the image forming device printing multiple pages.

3. The method of claim 1, further comprising determining whether the replaceable unit is near the end of its life, wherein the displaying the calculated number of pages remaining until the replaceable unit will reach the end of its life occurs in response to determining that the replaceable unit is near the end of its life.

4. The method of claim 3, wherein determining whether the replaceable unit is near the end of its life includes determining whether a performance metric associated with the replaceable unit has satisfied a predetermined performance threshold.

5. The method of claim 4, wherein determining whether the replaceable unit is near the end of its life includes determining whether one of a plurality of performance metrics associated with the replaceable unit has satisfied a predetermined performance threshold for such performance metric.

6. The method of claim 5, wherein the tracked discrepancy and the recalculated number of pages remaining are determined based on said one of the plurality of performance metrics that satisfied the predetermined performance threshold for such performance metric.

7. The method of claim 4, wherein the replaceable unit is an imaging unit having a toner sump for storing toner received from a toner cartridge, a photoconductive drum for supplying a toned image to a media sheet and a waste toner removal system having storage for waste toner and wherein the performance metric of the imaging unit is at least one of a number of pages printed, an amount of toner transferred to the storage for waste toner and a number of revolutions of the photoconductive drum.

8. The method of claim 4, wherein the replaceable unit is a fuser positionable in the image forming device to bond toner to a media sheet and wherein the performance metric of the fuser is at least one of a number of pages printed and a number of revolutions of a roll or a belt of the fuser.

9. The method of claim 3, wherein the replaceable unit is a toner cartridge having a reservoir for storing toner and an exit port in communication with an entrance port of an imaging unit of the image forming device for delivering toner from the reservoir to a toner sump of the imaging unit and determining whether the replaceable unit is near the end of its life includes determining whether the reservoir of the toner cartridge is out of usable toner.

10. The method of claim 9, wherein determining whether the reservoir of the toner cartridge is out of usable toner includes measuring an amount of toner in the toner sump of the imaging unit and concluding that the reservoir of the toner cartridge is out of usable toner when less than an expected amount of toner is measured in the toner sump.

11. A method for providing a page countdown for a toner cartridge removably installed in an image forming device, the toner cartridge having a reservoir for storing toner and an exit port in communication with an entrance port of an imaging unit of the image forming device for delivering toner from the reservoir to a toner sump of the imaging unit, the method comprising:

determining whether the reservoir of the toner cartridge is out of usable toner;

after determining that the reservoir is out of usable toner, displaying on a display screen of at least one of the image forming device and a device in electronic communication with the image forming device an estimate of the number of pages remaining before the toner sump of the imaging unit will run out of usable toner;

decreasing the displayed estimate of the number of pages remaining by one for each page printed by the image forming device using toner from the toner sump of the imaging unit;

tracking an error amount indicative of a discrepancy between the displayed estimate of the number of pages remaining and a number of pages remaining calculated based on the toner usage of the image forming device; and if the tracked error amount satisfies a predetermined error threshold, displaying the calculated number of pages remaining based on the toner usage of the image forming device and continuing decreasing the displayed estimate of the number of pages remaining by one for each page printed from the displayed calculated number of pages remaining.

12. The method of claim 11, wherein tracking the error amount includes tracking an amount of error accumulated over the course of the image forming device printing multiple pages.

13. The method of claim 11, wherein determining whether the reservoir of the toner cartridge is out of usable toner includes measuring an amount of toner in the toner sump of the developer unit and concluding that the reservoir of the toner cartridge is out of usable toner when less than an expected amount of toner is measured in the toner sump.

14. The method of claim 11, further comprising determining a number of pels printed and calculating the calculated number of pages remaining based on the determined number of pels printed.

15. The method of claim 14, further comprising determining a number of pels printed after the reservoir is out of usable toner and calculating the calculated number of pages remaining based on the determined number of pels printed after the reservoir is out of usable toner.

16. The method of claim 11, further comprising determining an average toner usage per page printed and calculating the calculated number of pages remaining based on the determined average toner usage per page printed.

* * * * *